US006517012B1

(12) United States Patent
Slowik et al.

(10) Patent No.: US 6,517,012 B1
(45) Date of Patent: Feb. 11, 2003

(54) METHOD FOR VARYING THE SWIRLING MOVEMENT OF A FLUID IN THE SWIRL CHAMBER OF A NOZZLE, AND A NOZZLE SYSTEM

(76) Inventors: Günter Slowik, Gotthardstrasse 2, D-06217 Merseburg (DE); Jürgen Kohlmann, Am Weinbergsrain 24, D-06217 Geusa (DE)

( * ) Notice: Subject to any disclaimer, the term of this patent is extended or adjusted under 35 U.S.C. 154(b) by 0 days.

(21) Appl. No.: 09/646,283

(22) PCT Filed: Mar. 17, 1999

(86) PCT No.: PCT/EP99/01726

§ 371 (c)(1),
(2), (4) Date: Sep. 15, 2000

(87) PCT Pub. No.: WO99/47270

PCT Pub. Date: Sep. 23, 1999

(30) Foreign Application Priority Data

Mar. 18, 1998 (DE) ..... 198 11 736

(51) Int. Cl.[7] ..... B05B 1/34

(52) U.S. Cl. ..... 239/464; 239/461; 239/471; 239/489

(58) Field of Search ..... 239/461–464, 239/470–472, 488, 489, 493, 596, 379

(56) References Cited

U.S. PATENT DOCUMENTS

| | | | | |
|---|---|---|---|---|
| 1,822,047 A | * | 9/1931 | Leask | |
| 2,544,417 A | * | 3/1951 | Goddard | |
| 2,628,867 A | | 2/1953 | Purchas, Jr. | |
| 4,013,229 A | * | 3/1977 | Rohs | 239/493 |
| 4,087,050 A | * | 5/1978 | Tsuji et al. | 239/490 |
| 4,260,110 A | * | 4/1981 | Werding | 239/492 |
| 4,796,815 A | | 1/1989 | Greenberg | |
| 5,722,598 A | * | 3/1998 | Werding | 239/491 |

FOREIGN PATENT DOCUMENTS

| | | |
|---|---|---|
| DE | 893 133 | 7/1949 |
| DE | 39 36 080 | 5/1991 |
| EP | 0 794 383 | 9/1997 |
| GB | 858 948 | 1/1961 |
| GB | 878 785 | 4/1961 |
| GB | 2 001 262 | 1/1979 |

* cited by examiner

*Primary Examiner*—Michael Mar
*Assistant Examiner*—Dinh Q. Nguyen
(74) *Attorney, Agent, or Firm*—Collard & Roe, P.C.

(57) ABSTRACT

A method for modifying the swirl motion of a liquid in the swirl chamber of a nozzle, and a swirl generator for nozzles. Such nozzles are used in industrial burners, oil burners and installations for cleaning flue gas and spray-drying food. The invention provides a method and nozzle for adjusting the man droplet diameter at a constant volume flow rate on maintaining the droplet spectrum constant in case of adjustment of the volume flow rate. Partial flows are distributed across supply channels which differ in terms of their cross sections at their point of connection with the swirl chamber. When the partial flows are constituted by the sum of cross-sections of the channels branching off the corresponding flow. Thus, the sums of the cross-sections at the connection point with the swirl chamber are different.

50 Claims, 9 Drawing Sheets

METHOD FOR VARYING THE SWIRLING MOVEMENT OF A FLUID IN THE SWIRL CHAMBER OF A NOZZLE, AND A NOZZLE SYSTEM

CROSS-REFERENCE TO RELATED APPLICATIONS

This application is based on PCT/EP99/01726 filed on Mar. 17, 1999, which claims priority from German No. 198 11 736.1 filed on Mar. 18, 1998.

BACKGROUND OF THE INVENTION

1. Field of the Invention

The invention relates to a method for varying the swirling movement of a fluid in the swirl chamber of a nozzle, and to a nozzle system for carrying out the method. Such nozzles are used, in particular, in industrial burners, oil burners and systems for washing flue gas and for the spray-drying of foodstuffs.

2. The Prior Art

It is frequently desired to be able to vary the atomization characteristic when atomizing liquids with the aid of swirl nozzles. It is possible to influence the drop size of the spray produced by varying the circumferential speed (swirling movement or swirl component) of the fluid in the swirl chamber. It is important here that the circumferential speed can be varied independently of the liquid throughput, and also that there is no need to undertake mechanical variation at the nozzle. So-called spill-return nozzles (bypass nozzles) constitute a variant. With these nozzles, the liquid is directed tangentially into the swirl chamber and drained off both from the nozzle outlet opening and through a return-flow opening on the middle of the axis. This portion of the liquid throughput is led back again into the liquid reservoir. By varying the return rate, the liquid throughput which is atomized can be kept constant, although the inlet speed of the liquid into the swirl chamber can be varied and thereby adjusted to the swirl intensity and, consequently, to the drop quality. The disadvantage of this solution consists in the necessity of conducting liquid in a circuit. The control range of the spill-return nozzles is bounded below. There is a substantial variation in the jet angle with the desired control range.

Also known are so-called "duplex nozzles" (DE-C 893 133 and U.S. Pat. No. 2,628,867), which are used for atomizing fuels. The nozzles have a swirl chamber into which the fuel is introduced via a plurality of tangential feed channels, and is set rotating about an axis. The nozzles can have different cross-sectional surfaces at the connecting point to the swirl chamber, and the tangential feed channels are connected to separate feed conduits. Incorporated into one of the feed conduits inside the nozzle is a valve which is opened as a function of the pilot pressure present in the other feed conduit, and permits the feed of a larger fuel quantity. The disadvantage of the "duplex nozzles" resides chiefly in the fact that they can implement only a limited possibility of regulation and control which is a function of the pilot pressure present or throughput. U.S. Pat. No. 4,796,815 describes a shower head for a hand-held shower in the case of which the incoming water flow is introduced via two tangential and two radial channels into a swirl chamber, in which a rotatable ball is also located, as well. The water feed in the nozzle head may be varied by means of an adjusting element which can be actuated by hand; either the water inlet into the tangential channels or into the radial channels is covered, or the radial and tangential channels are only partially covered. Different spray patterns are obtained by means of these possible adjustments. The disadvantage of this spray head consists in that for the purpose of generating different spray patterns the adjusting element is arranged inside the swirl chamber, and this varies the inlet surfaces of the tangential and radial channels. This shower head is essentially limited in its application to the sanitary field.

DE 39 36 080 C2 has disclosed a method for varying the circumferential speed component of the swirl flow of a fluid at the outlet from a swirl nozzle having a swirl space with a plurality of tangential feed lines. The entire material flow of the fluid is subdivided into at least two subflows, it being possible to vary the size of at least one subflow. The subflows are fed into the tangential feed conduits of the swirl space. It is disadvantageous that the achievable control range depends on the number of the feed conduits, the result being a rise in the outlay of production for the nozzles with a wide control range. Although rotational symmetry of the flow is achieved, the control range remains narrow. The known nozzles for industrial burners have the disadvantage that the burner output must be kept constant, because otherwise undesired pollutant emissions occur, in particular when the throughput is varied. Remedy is frequently found with a plurality of nozzles, it being possible to achieve optimum conditions only for one operating case. With the known nozzle systems used in spray-drying, a system start-up time of 2 to 3 hours is required when switching products. The powder produced during the start-up time cannot be reused, and must be recycled with considerable outlay. Moreover, it is not possible to influence variations in the product quality and product specification during the operation of production with the aid of the known nozzle systems. The reason for these disadvantages in the known swirl nozzles is their limited and/or inadequate control range.

SUMMARY OF THE INVENTION

It was the object of the invention to create an improved method for varying the swirling movement of a fluid in the swirl chamber of a nozzle which renders it possible to be able to operate a nozzle with a wide control range and, in the process, to achieve as far as possible a comparable drop quality (mean drop diameter and drop distribution), that is to say to create possibilities of being able to control the mean drop diameter in conjunction with a constant volumetric flow, or to keep the drop spectrum constant in conjunction with controlling the volumetric flow. The aim is also to create a suitable nozzle system for the purpose of carrying out the method.

According to the invention, the object is achieved by means of the features specified in claims 1 and 18. Corresponding variant refinements of the proposed method are specified in claims 2 to 17. Advantageous refinements of the nozzle system are the subject matter of claims 19 to 32.

The proposed method for subdividing the subflows over tangential feed conduits which differ in their cross-sectional surfaces at the connecting point to the swirl chamber, it being the case that upon subdivision of the subflows over more than two tangential feed conduits, the cross-sectional surfaces are formed from the sum of the cross-sectional surfaces of the feed conduits which branch off from the respective subflow, and the sums of the cross-sectional surfaces at the connecting point to the swirl chamber of the respective subflows therefore differ, leads to a substantial widening of the control range during operation of the nozzle systems. The possibility of controlling the drop spectrum in conjunction with a constant volumetric flow, or of keeping the drop spectrum constant in conjunction with variation in the volumetric flow is particularly advantageous in the practical use of the nozzles. The term fluid is to be understood within the scope of the present invention as also including mixtures of different fluids with or without solids. The control possibilities, created by the new method, for different nozzle applications result in improved productivity of the production systems, and in a substantial cost reduction. In order to ensure a wide control range, the cross-sectional surfaces should differ by a factor of more than four. According to the invention, the liquid throughput is subdivided into a plurality of subflows which have different cross-sectional surfaces. It is the cross-sectional surfaces at the inlet of the liquid into the swirl chamber (connecting point of the feed conduit and swirl chamber) which are decisive, since the circumferential speed at the periphery of the swirl chamber is fixed at this point. If the aim is a high swirl intensity for a fine drop spectrum, it is necessary to enlarge the subflow applied to the feed conduits which have the smallest cross section, and vice versa. Intermediate values can be set continuously. The simplest way of influencing the throughput of a subflow is to use a valve. The other object for which the method may be applied is to maintain a specific swirl intensity at the outlet from the swirl chamber. In this case, the ratio of the sum of the cross-sectional surfaces of the feed conduits which are affected in the full load case, and the sum of the cross-sectional surfaces of the feed conduits which are affected in the part load case is to be selected to be at least as high as the desired ratio of the volumetric flows in the cases of full load and part load. The principle of swirl control according to the invention can be applied during atomization of liquids in single-component and double-component nozzles in which either the liquid or the gas or both are provided with a circumferential speed in the nozzle. The application is performed in such a way that the method is applied both [sic] to the liquid or the gas or to both. It is therefore possible to influence the drop quality in the case of double-component nozzles without changing the liquid throughput/gas throughput ratio. The purpose for which the liquid is atomized is not important here. The atomization can be performed, for example, for subsequent drying of a suspension in the dry tower. However, it is also possible to atomize oil which, as customary with burners, is burnt at the nozzle outlet. However, the fluid can also be a gas. This case is possible with multiple-component nozzles, where the gas is provided with a swirl component in order to atomize liquid. However, the gas can also be provided with a swirl component without the presence of liquid, as in the case of gas burners which operate with recirculation in the vicinity of the nozzle outlet. Finally, it is possible to combine the principle according to the invention with the spill-return method, in order to permit a further widening of the control range. With most spray-drying systems, the use of return flow nozzles is precluded for quite different reasons. In the case of these systems, it has previously been necessary to operate with a prescribed nozzle geometry. The frequent changes in the product therefore necessitated a new selection of the nozzle system and, because of the change of nozzle required, the system had to be run up and run down. The new system renders it possible to adapt during operation, and it is even possible to carry out control owing to continuous measurement of the product parameters. Variations in the product parameters which result from wear of the nozzle can be leveled out over a certain time, and the service life of the spray tower can be prolonged thereby. In the case of using the invention in the field of oil combustion, success is achieved in operating with a wide load range without the return line and without varying the jet angle in conjunction with a virtually unchanged drop size. This influences the effectiveness of the entire heating system and the service life of the boiler, since in the case of fluctuating heat requirements there is no need to implement frequent running up and running down of the burner. The method according to the invention can also be successfully applied in the case of gas burners and coal dust burners, chiefly in order to influence the shape of the burner flame. In the case of the application of the invention to fuel atomization in turbines, a reaction to different operating requirements is rendered possible. It is necessary to adapt the fuel atomization in aircraft turbines because of different load requirements (launch period, normal flight) or because of different combustion conditions (the density and composition of air vary as a function of altitude). This is now possible when applying the method according to the invention. Further detailed discussions on the method and the design of the nozzles emerge within the framework of the following exemplary embodiments.

DETAILED DESCRIPTION OF THE PREFERRED EMBODIMENT

Figure 1:
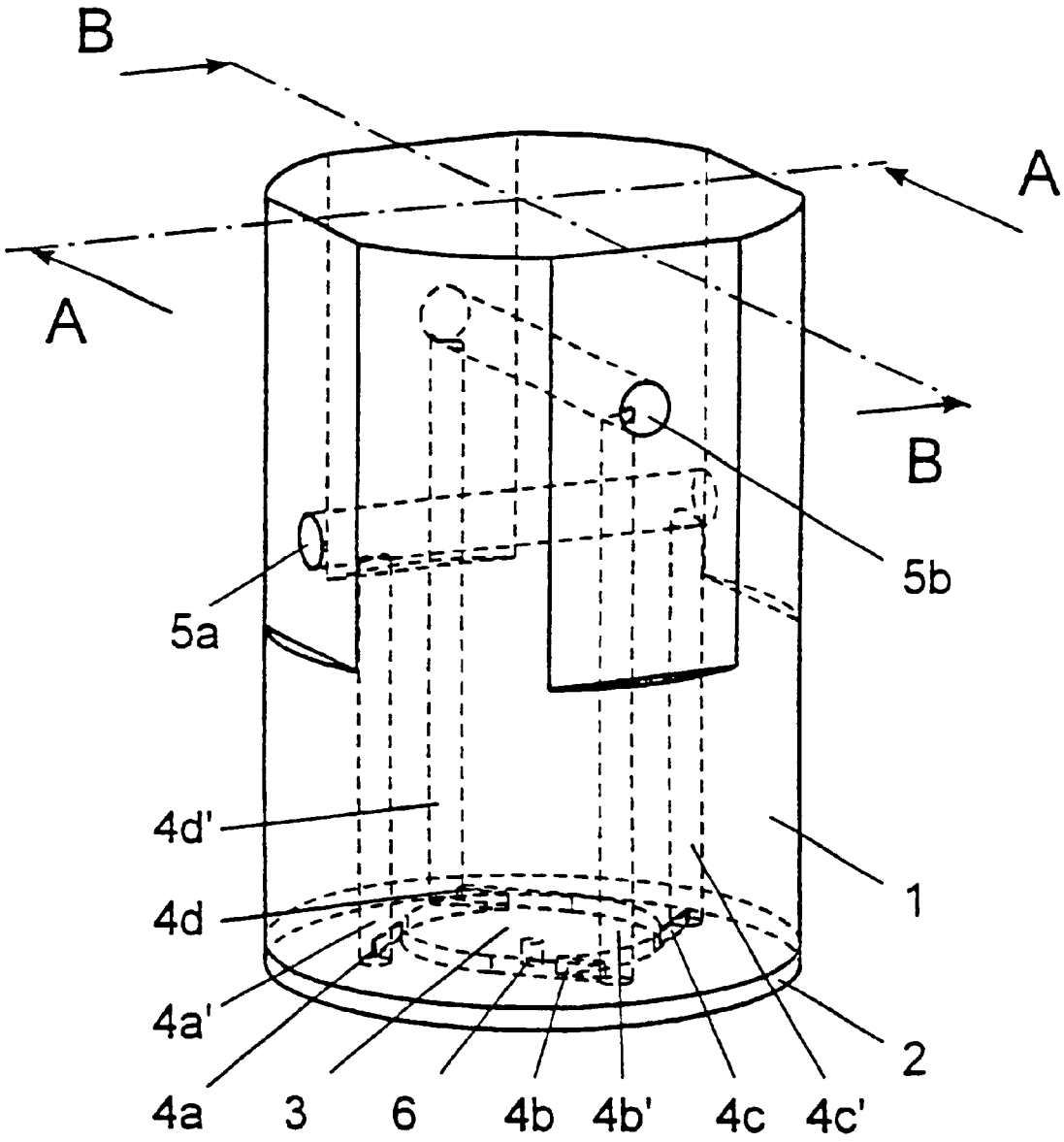
FIG. 1 shows a nozzle according to the invention in a three-dimensional diagrammatic representation.
Figure 2:
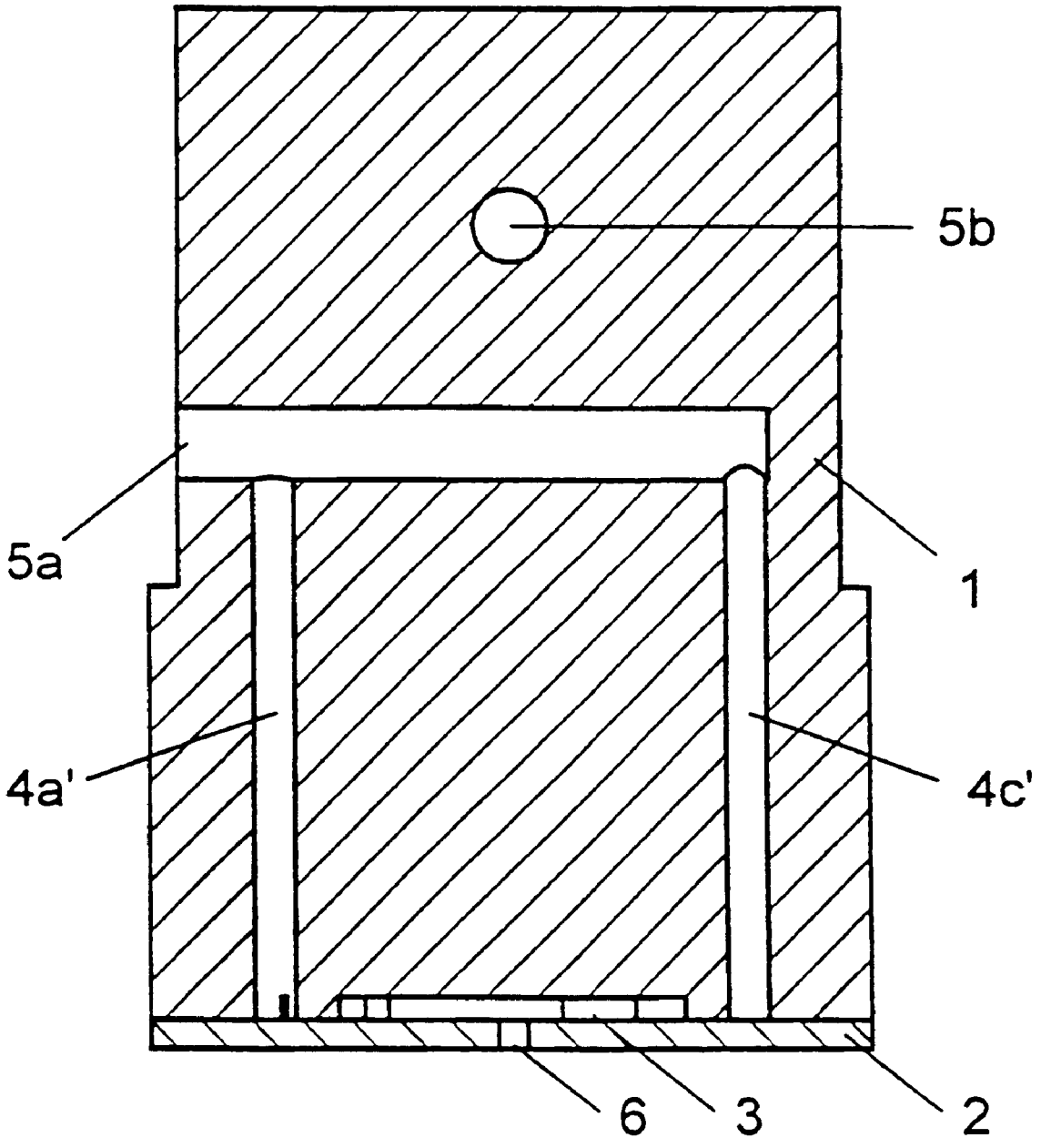
FIG. 2 shows a longitudinal section in accordance with the line A—A in FIG. 1.
Figure 3:
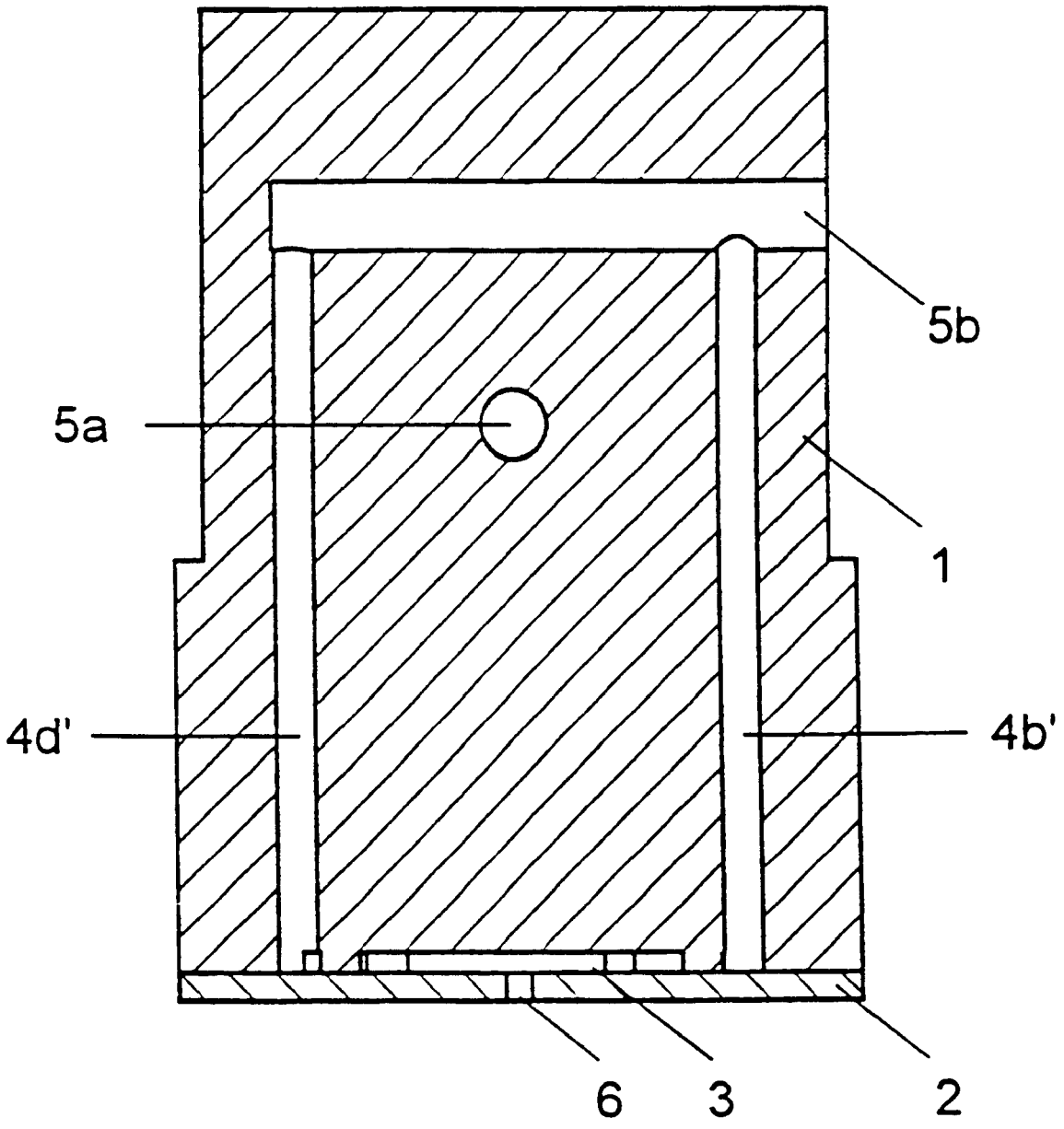
FIG. 3 shows a longitudinal section in accordance with the line B—B in FIG. 1.
Figure 4:
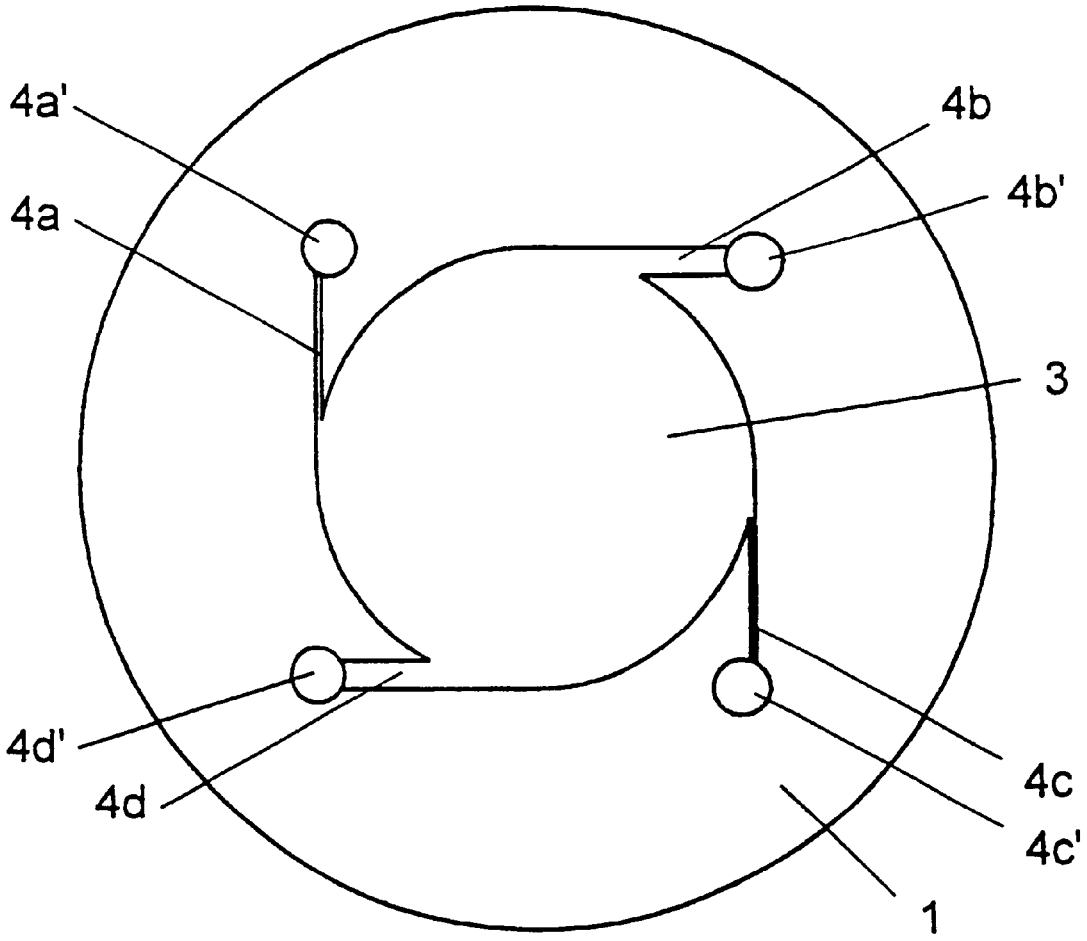
FIG. 4 shows a bottom view of the nozzle in accordance with FIG. 1, without cover plate.
Figure 5:
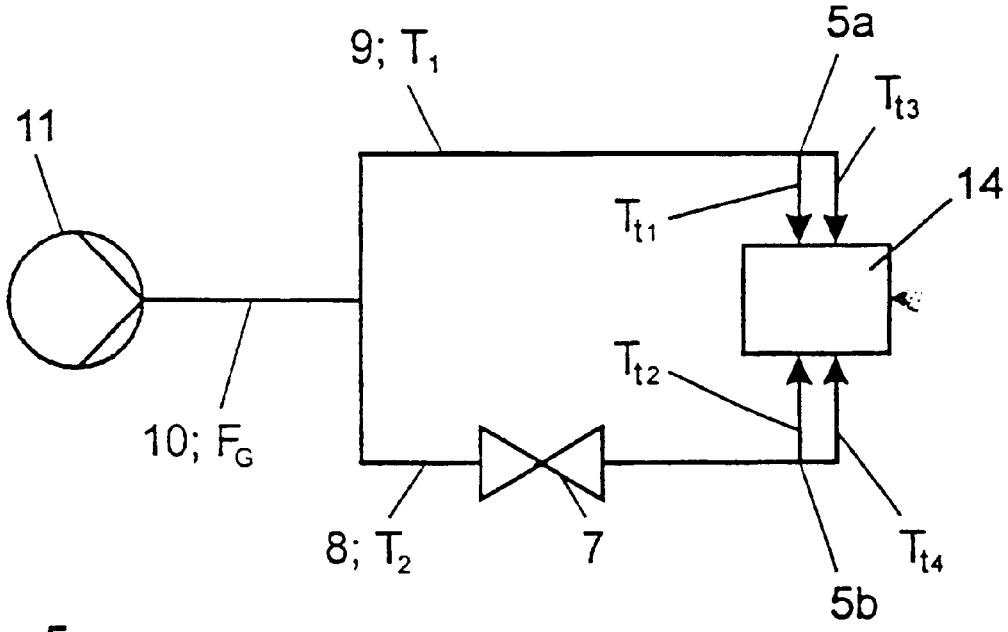
FIG. 5 shows a circuit diagram for subdividing the fluid flow for the nozzle represented in FIG. 1.
Figure 7:
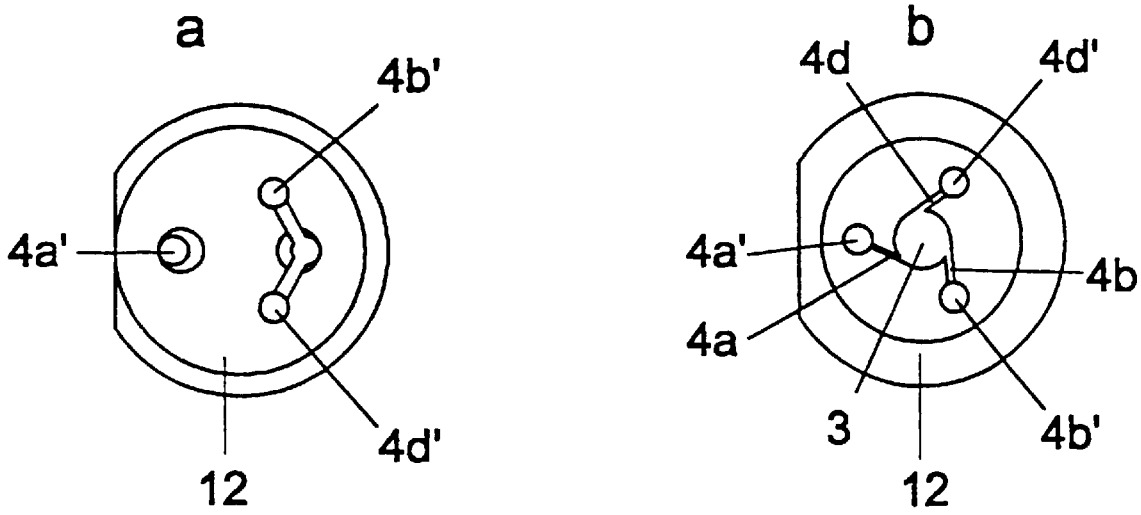
FIG. 7 shows the swirl member of the nozzle in accordance with FIG. 6.
Figure 8:
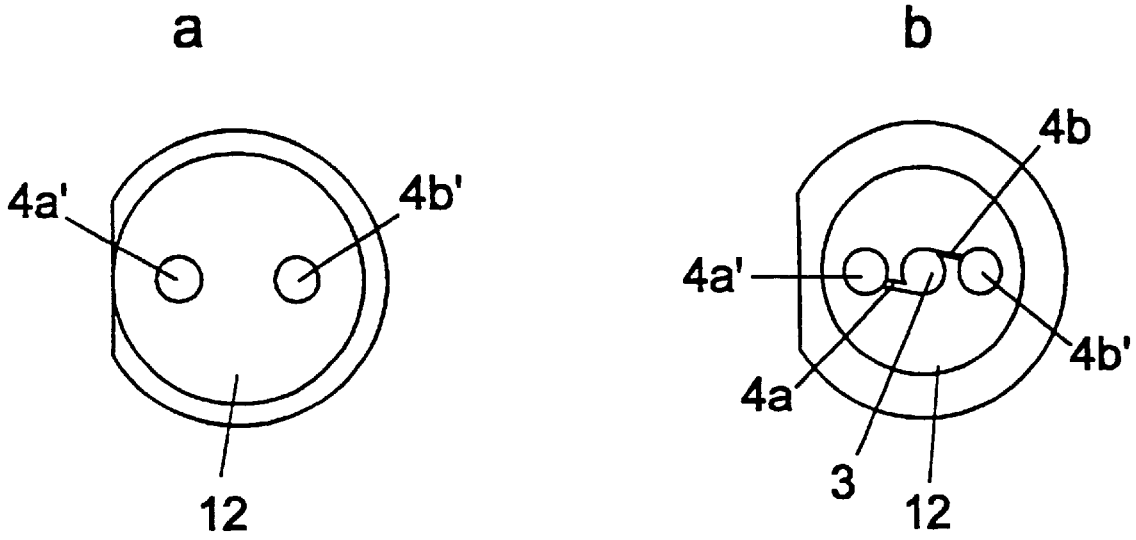
FIG. 8 shows a further swirl member for a nozzle in accordance with FIG. 6.

The nozzle represented in FIG. 1 comprises the nozzle body 1 and the cover plate or nozzle plate 2 arranged at the outlet end of the nozzle. Arranged in the nozzle body 1 above the swirl chamber 3 are two feed lines 5*a* and 5*b* which are mutually spaced in the axial direction and whose inlet openings are offset by 90°. The feed lines 5*a* and 5*b* run horizontally at a spacing from the nozzle plate 2. The openings of the feed lines 5*a* and 5*b* are connected via separate lines 8, 9 to a central line 10 for feeding the total fluid flow $F_G$ (FIG. 5). A feed pump 11 is incorporated into the line 10. A valve 7 is incorporated as a control member in the line 8 which branches off from the line 10 and is connected to the feed line 5*b*. Representation of details of the fastening of the lines and the connection of the nozzle body 1 and cover plate 2 was dispensed with in the present drawing, since these are connecting techniques with which the person skilled in the art is conversant. Provided in the cover plate 2 is the nozzle outlet opening 6, which lies on the central axis of the nozzle and is connected to the swirl chamber 3 located above the cover plate 2 (FIGS. 2 and 3). The swirl chamber 3 has a constant height and a diameter which is five times the diameter of the nozzle outlet opening 6 in the cover plate 2. Opening into the swirl chamber 3 are four tangential feed conduits 4*a*, 4*b*, 4*c* and 4*d*, which have the same height in each case at the connecting point to the swirl chamber 3. The respectively opposite conduits 4*a* and 4*c* or 4*b* and 4*d* are connected to the feed lines 5*a* and 5*b*, respectively, via vertically arranged conduits 4*a*', 4*b*', 4*c*' and 4*d*'. The feed conduits 4*a* and 4*c*, which have the same cross section at the connecting point to the swirl chamber, are connected to the feed line 5*a* via the vertical conduits 4*a*' and 4*c*'. The definition of "cross-sectional surfaces" will be examined in further detail below. The feed line 5*b* is connected via the vertical conduits 4*b*' and 4*d*' to the tangential feed conduits 4*b* and 4*d*, which likewise have the same cross section at the connecting point to the swirl chamber 3. The feed conduits 4*a* or 4*c* and 4*b* or 4*d* differ in cross section at the connecting point to the swirl chamber 3; the feed conduits 4*a* and 4*c* are not as wide as the feed conduits 4*b* and 4*d*. The offset radial arrangement of the individual feed conduits, referred to their central axis, by 90° in each case were selected thus to maintain the symmetry of the flow of the fluid into the swirl chamber 3. The method and device are explained jointly with reference to achieving the control range. The first step is to consider the case in which the drop quality is to remain largely uniform in conjunction with a variable overall throughput. This is a requirement, for example, with oil burners. In the case of full load, the overall liquid throughput $F_G$ is subdivided over all the tangential feed conduits 4*a*, 4*b*, 4*c* and 4*d* by forming the tangential subflows $T_{t1}$, $T_{t2}$, $T_{t3}$ and $T_{t4}$. This is achieved by subdividing the total fluid flow $F_G$ into two subflows $T_1$ and $T_2$ which are respectively applied to the feed lines 5*a* and 5*b*. The subflow $T_2$ which is applied to the tangential feed conduits 4*b* and 4*d*, that is to say the tangential subflows $T_{t2}$ and $T_{t4}$ (FIG. 5) can be influenced by controlling the valve 7, that is to say the throughput of the tangential subflows $T_{t2}$ and $T_{t4}$ can be controlled thereby. The liquid flow $T_2$ is subdivided over the tangential feed conduits $T_{t2}$ and $T_{t3}$. The overall throughput drops in the case of part load. As a countermeasure, the subflow $T_2$ in the branch line 8, which supplies the tangential feed conduits 4*b* and 4*d* via the feed line 5*b*, is choked by means of the valve 7. A larger throughput $T_{t1}$ and $T_{t3}$ thereby passes into the tangential feed conduits 4*a* and 4*c*. The inlet speed in these feed conduits rises there despite a falling overall throughput, and therefore leads to a constant swirling movement at the outlet opening 6 of the nozzle. The lowermost limit of constant drop quality is reached when the overall throughput is still just directed through the feed conduits 4*a* and 4*c*, and the feed conduits 4*b* and 4*d* are no longer affected. If the overall throughput drops even more strongly, an increase in the mean drop diameter can be expected. The second case which can be treated using the method according to the invention is the control of the drop size in conjunction with a throughput which remains constant. The subflows are subdivided in a way similar to the first case. If the drop size is to be reduced in conjunction with the same throughput, it is necessary to increase the subflow which supplies the feed line 5*a*. The overall throughput is to be kept constant by means of an appropriate circuit. The opposite procedure is to be adopted if a larger drop size is desired. A further variant embodiment of a nozzle is shown in an exploded representation in FIG. 6 and has three tangential feed conduits. To ease comprehension, the nozzle is shown in two views—the view a as a vertical arrangement of the nozzle, and the view b as an arrangement inclined about the central axis. The nozzle comprises the base body or nozzle body 1, the swirl member 12, the cover plate or nozzle plate 2 and the cap 13, which is screwed onto tile nozzle body 1. By comparison with the nozzle represented in FIGS. 1 to 4, the feed lines 5*a* and 5*b* are arranged not horizontally but vertically in the nozzle body 1. The subdivision of the feed lines 5*a* and 5*b* over the vertical conduits 4*a*', 4*b*' and 4*d*' as well as the tangential feed conduits 4*a*, 4*b* and 4*d*, which open into the swirl chamber 3, is performed in the swirl member 12, which is designed as an interchangeable insert. Arranged on the underside of the swirl member is a corresponding cutout for the nozzle plate 2, in which the nozzle outlet opening 6 is located. The line branches 8 and 9, which are connected to the feed lines 5*a* and 5*b*, as well as the line 10 for the total fluid flow with the pump 11, and the arrangement of the control valve 7, which is incorporated into the line 8, which is connected to the line 5*b*, are not represented again in this figure. The feed line 5*a* merges in the swirl member 12 into the vertical conduit 4*a*', which opens into the tangential feed conduit 4*a*. The feed line 5*b* merges in the swirl member 12 into two vertical conduits 4*b*' and 4*d*', which are respectively connected to a tangential feed conduit 4*b* or 4*d* (FIG. 7). Two different varied embodiments of the swirl member 12 are represented in FIGS. 7 and 8, as a top view a or bottom view b, respectively. The swirl member 12 in accordance with FIG. 7 is identical to the swirl member shown in FIG. 6. Unlike the latter, the swirl member 12 in accordance with FIG. 8 is equipped only with two tangential feed conduits 4*a*, 4*b*. The view a shows the top view, and the view b the bottom view, respectively. In the variant shown in FIG. 7, the fluid subflow $T_1$ flowing through the feed line 5*b* is subdivided into two tangential subflows $T_{t2}$ and $T_{t4}$, and the other subflow $T_2$ passes into the tangential feed conduit 4*a* without further subdivision. In the variant shown in FIG. 8, the subflows $T_1$ and $T_2$ are not further subdivided and are fed to the swirl chamber 3 via the respective associated tangential feed conduit 4*a* or 4*b*.

Figure 6:
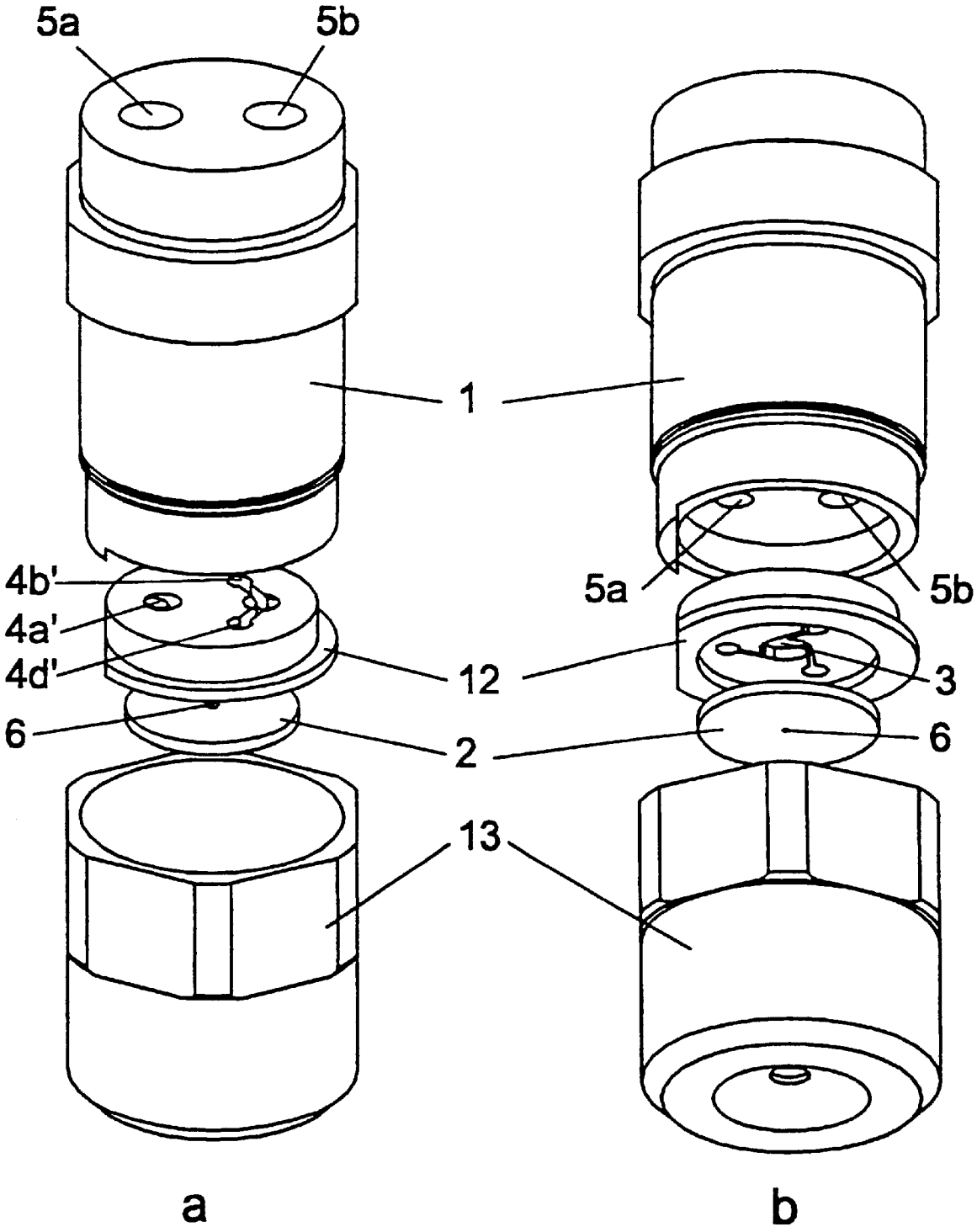
FIG. 6 shows a further variant embodiment of a nozzle, in an exploded representation of two different views.
Figure 9:
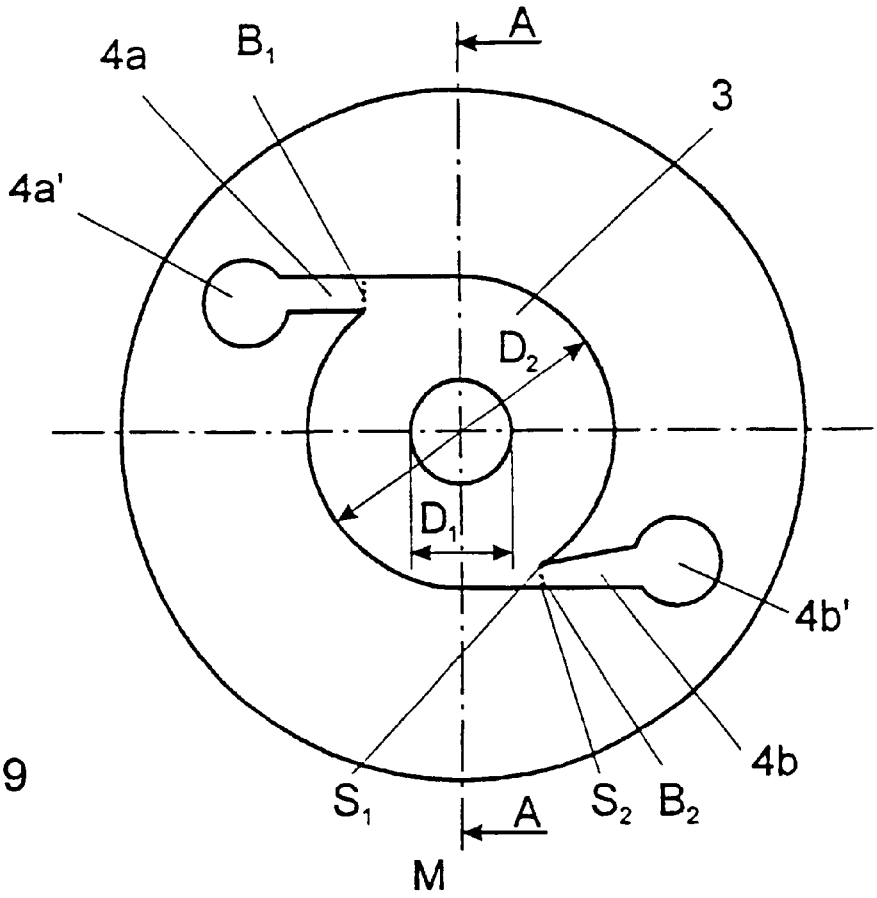
FIG. 9 shows the top view of a swirl member in an enlarged representation.
Figure 10:
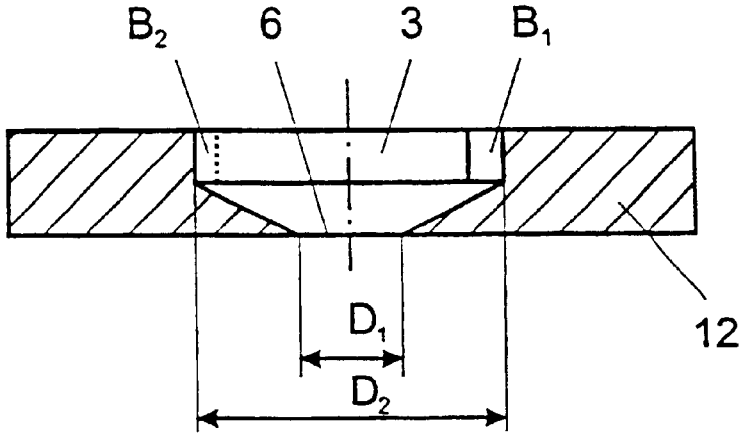
FIG. 10 shows a section in accordance with the line A—A in FIG. 9, rotated by 90°.

The advantage of the nozzle shown in FIG. 6 consists chiefly in that different variant methods can be realized by exchanging the swirl member without the need to replace the entire nozzle. The details of the respective nozzle can be configured differently in design terms. This also dependent, in particular, on the respective case of use or application of the nozzles. The top view of a swirl chamber 3 is represented in an enlarged fashion in FIG. 9, two tangential feed conduits 4*a* and 4*b* opening into the said chamber. The two feed conduits 4*a* and 4*b* have different cross-sectional surfaces at the connecting point to the swirl chamber 3. The tangential feed conduits of a nozzle have the same height at the connecting point to the swirl chamber 3, and can differ in width, if required, as illustrated in FIG. 9 by the width dimensions $B_1$ and $B_2$. The respective width dimension is the distance between two points of intersection $S_1$ and $S_2$ lying on a line parallel to the central axis M, the point of intersection $S_1$ being the point of intersection between the lateral surface of the swirl chamber and the wall, adjacent thereto, of the tangential feed conduit, and the point of intersection $S_2$ is the point of intersection of the parallel line with the opposite wall of the tangential feed conduit. The connecting point of the tangential feed conduits to the swirl chamber can also be designed as a circular cross section, in which case different cross-sectional surfaces are then achieved in a similar way by means of different diameters of the respective bores at this point. It also emerges clearly from FIG. 9 that the tangential feed conduits 4*a* and 4*b* can be of different design outside the connecting point to the swirl chamber, for example they can have a constant conduit cross section, or the conduit cross section can taper in the direction toward the swirl chamber. In the case of two tangential feed conduits of a nozzle, as represented in FIGS. 9 and 10, it is mandatory for these conduits to have different cross-sectional surfaces at the connecting points to the swirl chamber. In the case of more than two tangential feed conduits, the latter can have the same cross-sectional surface at the connecting point to the swirl chamber, it then being essential only that the sums of the relevant cross-sectional surfaces which are assigned to the respective subflows $T_1$ and $T_2$ or the associated conduits differ. A further important design feature is the ratio of the diameter $D_1$ of the nozzle outlet opening to the diameter $D_2$ of the swirl chamber, the aim being that the ratio $D_2$:$D_1$ should be in a range from 2 to 12. In the case of a design of a nozzle with a plurality of tangential feed conduits, it is expedient if the latter are distributed uniformly over the circumference of the inner lateral surface of the swirl chamber. It has proved to be advantageous for the swirl chamber and the cross sections of the tangential feed conduits at the connecting point to the swirl chamber to be dimensioned in accordance with a specified ratio, and specifically as follows:

$$\frac{2B}{D_2 - D_1} < 0.5$$

Figure 11:
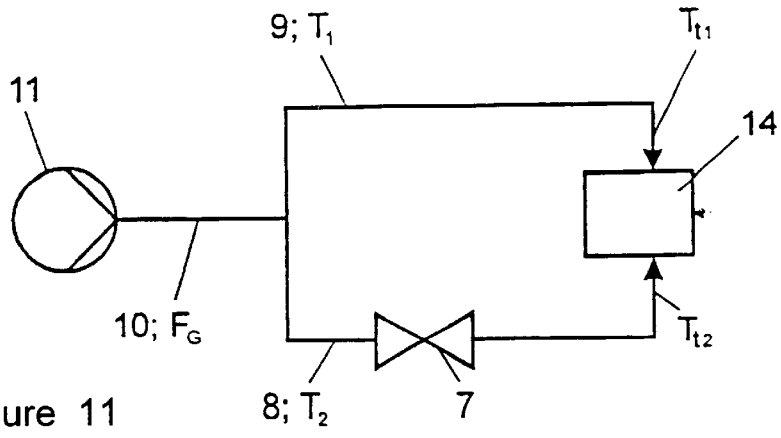
FIG. 11 shows a circuit diagram for a nozzle having two tangential feed conduits.
Figure 12:
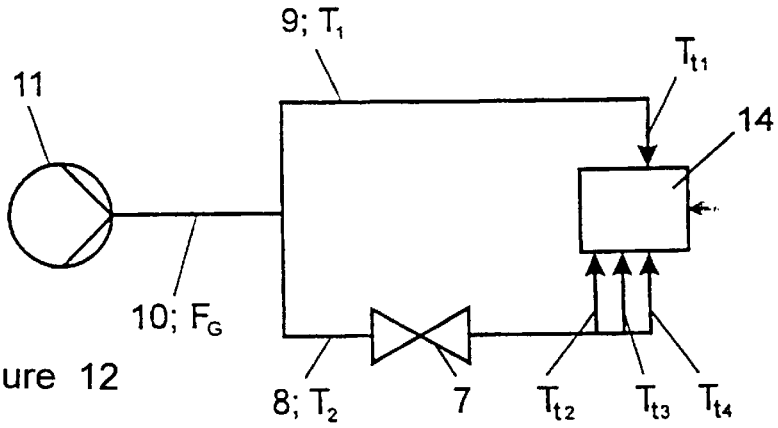
FIG. 12 shows a circuit diagram for a nozzle having four tangential feed conduits.
Figure 13:
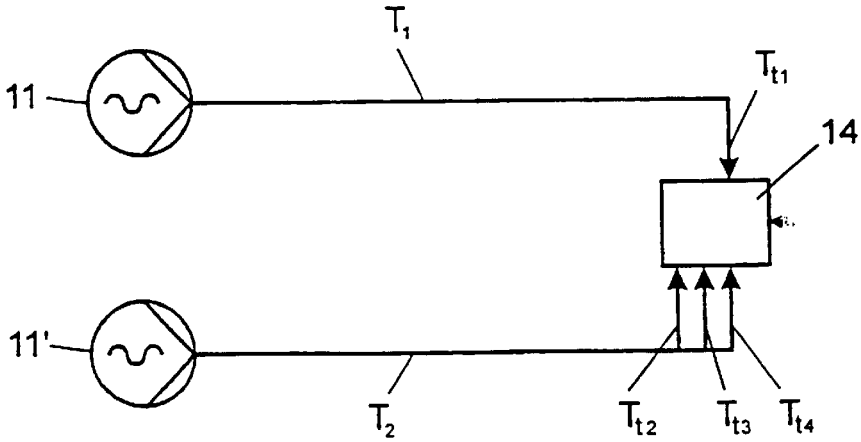
FIG. 13 shows a circuit diagram for a further variant embodiment for a nozzle having four tangential feed conduits.

B signifying either the width or the diameter of the conduit at the connecting point to the swirl chamber, and $D_1$ and $D_2$ being the diameters of the outlet nozzle and the swirl chamber, respectively, as explained above. In a way known per se, the height of the swirl chamber is a lesser dimension than the diameter. The larger the ratio of the swirl chamber diameter to the nozzle outlet diameter ($D_2$:$D_1$), the more effectively a potential vortex can form and a high circumferential speed, which is a precondition for good atomization of the fluid, can be set up at the nozzle outlet. In the case of a large swirl chamber diameter, the speeds at the inner lateral surface of the swirl chamber can also be lower than in the case of smaller swirl chamber diameters, since, because of the larger radial distance to the nozzle outlet opening higher circumferential speeds are formed. Consequently, in the case of larger swirl chamber diameters the cross-sectional surfaces of the feed conduits can be of larger design. The production of the tangential feed conduits is thereby rendered simpler, and the risk of blockage drops. In the case of an excessively large ratio of the swirl chamber diameter to the nozzle outlet diameter, however, there is a decrease in the circumferential speed because of the wall friction. Various circuit arrangements for different variant embodiments of nozzles are represented in FIGS. 11 to 13. It holds for all the circuit variants shown, including that in accordance with FIG. 5, that the control intervention in the throughput of the fluid flow is undertaken outside the nozzle either via a valve or separate pumps. Controllers or control members are understood to be all possibilities of intervention which act on the throughput of the fluid flow such as, for example, throttling by means of valves, influencing the characteristic of a pump by changing the speed of the latter, or the like. The further subdivision of the total fluid flow $F_G$ into further subflows $T_1$, $T_2$ etc. can be anticipated either inside or outside the nozzle. The subflows $T_{t1}$ to $T_{t4}$ are always fed into the swirl chamber tangentially.

In the case of the embodiment shown in FIG. 10, the total fluid flow $F_G$ fed by a pump 11 is subdivided into two subflows $T_1$ and $T_2$, and fed to the swirl chamber via one tangential feed conduit $T_{t1}$ and $T_{t2}$ each, which have different cross-sectional surfaces at the connecting point to the swirl chamber 3 of the nozzle 14. A valve 7 is incorporated into the line for the subflow $T_2$, which is connected to the tangential feed conduit with the larger cross-sectional surface at the connecting point to the swirl chamber. An appropriate throttling of the subflow $T_2$ simultaneously varies the tangential subflow $T_{t2}$ and thus influences the circumferential speed of the fluid in the swirl chamber, and thereby the drop spectrum when the fluid emerges from the nozzle.

This basic variant entails the lowest outlay on production. The case with a constant liquid throughput will be discussed. The liquid is fed via a line, and two subflows are formed by a bifurcation. The size of one subflow can be limited by a valve. Downstream of the valve, the subflow is fed to the feed conduit with the larger cross-sectional surface. The two limiting cases are given, namely when the valve is fully open or fully closed. In the case of a fully opened valve, the liquid throughput is distributed over both feed conduits. The circumferential speed has its lowest value at the inner lateral surface of the swirl chamber, and the circumferential speed is thereby also lowest at the nozzle outlet. The highest value is assumed by the circumferential speed at the nozzle outlet when the valve is closed. The ratio of the smallest cross-sectional surface of the two feed conduits determines the ratio of part load to full load which can be achieved, and in the case of which the atomization properties do not essentially change. The circuit variant shown in FIG. 11 corresponds to the nozzle, shown in FIG. 6, having a swirl member 12 in accordance with FIG. 8. The circuit variant represented in FIG. 12 differs from the circuit variant shown in FIG. 11 only in that the subflow $T_2$ is not subdivided into one tangential subflow, but over three tangential subflows $T_{t2}$, $T_{t3}$ and $T_{t4}$ whose sum of the cross-sectional surfaces of the tangential feed conduits at the connecting point is larger than the analogous cross-sectional surface for the tangential subflow $T_{t1}$. If the larger cross-sectional surface is designed in the case of a circuit variant in accordance with FIG. 11 to be very large in relation to the smaller cross-sectional surface, there is the risk that asymmetries can occur in the flow of the fluid in the swirl chamber. The variant represented in FIG. 12 is proposed in order to avoid this disadvantage. The same variant renders it possible to arrive at feed conduits which are arranged over the inner lateral surface of the swirl chamber and therefore lead-to a symmetrical flow. The sum of the cross-sectional surfaces of these tangential feed conduits is larger at the connecting point than that of the remaining feed conduit which is fed by the subflow which is not influenced directly via the valve.

In the case of the circuit variant shown in FIG. 13, the design of the nozzle is similar to the case of the design in accordance with FIG. 12. The difference consists in that there is no branching of a total fluid flow, but two separate subflows $T_1$ and $T_2$ are influenced independently of one another via eccentric worm screw pumps 11, 11' incorporated into the lines, and specifically by a change in the speed of the pumps. In the case of the conveyance of suspensions, it is sometimes necessary to avoid blockage through line cross sections, as in the case of valves or cocks, since obstructions can otherwise occur. It is therefore necessary to use a variant in which subflows can be influenced in another way. This can be performed by positive displacement pumps whose discharge characteristic is varied. In accordance with this variant, use is made in each subflow of eccentric worm screw pumps 11, 11' whose throughput is adapted via a change in speed. The present invention can also be applied in such cases where it is necessary in conjunction with different throughputs to keep the jet angle of the fluid emerging from the nozzle constant, that is to say to influence the control of the jet angle. In the case of conventional swirl nozzles, a larger jet angle is achieved with increasing throughput. An increase in the jet angle with increasing overall throughput is likewise to be noted in the case of the method according to the invention in conjunction with a constant ratio of subflows. The following situation results in the case of the use of the circuit variant in accordance with FIG. 11. For a given outlet pressure, the overall throughput can be increased by opening the valve. The jet angle is thereby slightly increased. Thus, if the outlet pressure is lowered when the valve is closed, a constant jet angle is achieved.

What is claimed is:

1. A method for changing the a swirling motion of a stream of fluid in a nozzle comprised of a nozzle body (1) with a swirl chamber (3) having an outlet, comprising:

dividing a total fluid stream (FG) is divided in two partial streams wherein least a through-put of one of the partial streams is variable;

allocating each of said partial streams to a tangential inlet channel (4*a*, 4*b*), said inlet channels being different in their cross sectional areas at a point of connection with the swirl chamber (3); and admitting the partial streams into the swirl chamber (3) through said tangential inlet channels, wherein a the swirling motion produced in the swirl chamber is not coupled to a total through-put of the stream of fluid, wherein the division and allocation of the total stream of fluid to the individual partial streams received in the swirl chamber (3) is carried out under operating conditions independent of the through-put for realizing different control possibilities.

2. The method according to claim 1, wherein the steps of dividing and allocating the partial streams (T1, T2) to the tangential inlet channels (4*a*, 4*b*) are carried out so that when a higher degree of swirling is required on the outlet from the swirl chamber (3), a larger partial stream (T2) of fluid is admitted to the tangential inlet channel with a smaller cross sectional area at the point of connection (S1, S2) to the swirl chamber (3) and vice versa.

3. The method according to claim 1, wherein the partial stream associated with a larger cross sectional area at the point of connection (S1, S2) to the swirl chamber (3) is controlled by means of a control element (7).

4. The method according to claim 3, wherein at least one of a pump or a valve (7) are employed as the control element.

5. The method according to claim 1, wherein said two partial streams (T1, T2) are controlled independently of each other by changing volume of flow delivered by a pump (11, 11').

6. The method according to claim 1, wherein by differently controlling at least one of the partial streams (T1, T2) and dividing and allocating the partial streams (T1, T2) to the tangential inlet channels (4*a*, 4*b*), a ratio of dividing the partial streams (T1, T2) is influenced without any steps so that the swirling motion in the swirl chamber (3) is controlled, and a droplet size of fluid exiting from a nozzle outlet opening (6) is enlarged, reduced or maintained constant if changes occur in the material parameters of the fluid.

7. The method according to claim 1, wherein the through-put of the partial streams (T1, T2) is influenced outside of the nozzle (14).

8. The method according to claim 1, wherein in a presence of an increasing total through-put, an angle of injection of atomized fluid is maintained by reducing overall pressure of the fluid, and the partial stream (T2) allocated to the tangential inlet channel (4*a* or 4*b*) with a largest cross sectional area at the point of connection (S1, S2) to the swirl chamber (3) is increased versus the other partial stream (T1).

9. The method according to claim 1, wherein in a presence of a constant total through-put, an angle of injection of atomized fluid is increased by raising pressure of the total fluid and reducing the partial stream (T2) allocated to the tangential inlet channel (4*a* or 4*b*) with a largest cross sectional area at the point of connection (S1, S2) to the swirl chamber (3), versus the other partial stream (T1).

10. The method according to claim 1, wherein fluids are atomized with the help of gases, whereby the fluid or the gas or both are exposed either individually or in mixture to a variable swirling motion prior to exiting from the nozzle.

11. A method for changing a swirling motion of a stream of fluid in a nozzle comprised of a nozzle body (1) with a swirl chamber (3) and a plurality of inlet channels tangentially arranged on the swirl chamber (3), comprising:

dividing a total stream of fluid (FG) in several partial streams, wherein at least a through-put of one of the partial streams is variable;

allocating the partial streams to tangential inlet channels in such a way that at least one of the partial streams is divided and allocated to said tangential inlet channels;

admitting at least one of said partial streams into the swirl chamber (3) through at least two of said tangential inlet channels, wherein the swirling motion produced in the swirl chamber is not coupled to a total through-put of the stream of fluid, wherein a sum of cross sectional areas of the tangential inlet channels at a point of connection (S1, S2) to the swirl chamber (3) are different (a) from the sum of the cross sectional areas of the tangential inlet channels at the point of connection with the swirl chamber (3) of a further partial stream;

(b) from the cross sectional area of the tangential inlet channel at the point of connection to the swirl chamber of an additional partial stream if said additional partial stream is admitted into the swirl chamber only through one tangential inlet channel; and said steps of dividing and allocating the total stream of fluid to the individual partial streams received in the swirl chamber (3) are carried under operating conditions independent of the through-put for realizing different control possibilities.

12. The method according to claim 11, wherein the partial streams (T11, T12, T13, T14) are admitted into the swirl chamber (3) through identically sized and/or different cross sectional areas at the point of connection to the swirl chamber (3).

13. The method according to claim 11, wherein the steps of dividing and allocating the partial streams (T1, T2) to the tangential inlet channels (4*a*, 4*b*, 4*c*, 4*d*) are carried out so that when a higher degree of swirling is required on the outlet from the swirl chamber (3), a larger partial stream (T2) of fluid is admitted to the tangential inlet channels with a smaller sum of cross sectional areas at the point of connection (S1, S2) to the swirl chamber (3) and vice versa.

14. The method according to claim 11, wherein when the total stream of fluid (FG) is changed and the aim is to maintain a degree of swirling on the outlet from the swirl chamber (3) at a desired ratio of full-load/partial-load of the stream of fluid, the partial streams are divided so that a ratio of a sum of cross sectional areas of acted-upon inlet channels at full load to the sum of cross sectional areas of the tangential inlet channels acted upon at partial load corresponds at least with a ratio of volume of the stream at full load to partial load.

15. The method according to claim 11, wherein the total stream of fluid (FG) is divided in more than two partial streams (T11, T12, T13, T14) tangentially admitted into the swirl chamber (3), wherein at least two of said partial streams (T12, T13, T14) are branched off from a partial streams (T2); said one partial stream (T2) being controlled by a control element and wherein the tangential inlet channels (4*b*, 4*c*, 4*d*) of said one partial stream have a sum of cross sectional areas that amount to a highest value at the point of connection (S1, S2) to the swirl chamber (3).

16. The method according to claim 15, wherein at least one of a pump (11, 11') or a valve (7) are employed as the control element.

17. The method according to claim 16, wherein said two partial streams (T1, T2) are controlled independently of each other by changing volume of flow delivered by the respective pump (11, 11').

18. The method according to claim 11, wherein the total stream of fluid comprises two separate streams (T1, T2), wherein each of said separate streams (T1, T2) is controlled by a pump (11, 11') and at least one of said separate streams (T2) is divided and allocated to said several tangential inlet channels (4*b*, 4*c*, 4*d*) for forming additional partial streams (T12, T13, T14).

19. The method according to claim 11, wherein by differently controlling at least one of the partial streams (T1, T2) and dividing and allocating the partial streams (T1, T2) to the tangential inlet channels (4*a*, 4*b*, 4*c*, 4*d*), a ratio of dividing the partial streams (T1, T2) is influenced without any steps so that the swirling motion in the swirl chamber (3) is controlled, and a droplet size of fluid exiting from a nozzle outlet opening (6) is enlarged, reduced or maintained constant if changes occur in the material parameters of the fluid.

20. The method according to claim 11, wherein the partial streams (T11, T12, T13, T14) are supplied to the swirl chamber (3) on a same axial coordinate.

21. The method according to claim 20, wherein the partial streams (T11, T12, T13, T14) are admitted into the swirl chamber (3) uniformly distributed via a wall surface of the swirl chamber.

22. The method according to claim 11, wherein the through-put of the partial streams (T1, T2) is influenced outside of the nozzle (14).

23. The method according to claim 11, wherein the partial streams are divided into said further partial streams (T11, T12, T13, T14) inside or outside of the nozzle (14).

24. The method according to claim 11, wherein in a presence of an increasing total through-put, an angle of injection of atomized fluid is maintained by reducing overall pressure of the fluid, and the partial stream (T2) allocated to the tangential inlet channels (4*a*, 4*b*, 4*c*, 4*d*) with a largest sum of the cross sectional areas at the point of connection (S1, S2) to the swirl chamber (3) is increased versus the other partial stream (T1).

25. The method according to claim 11, wherein in a presence of a constant total through-put, an angle of injection of atomized fluid is increased by raising pressure of the total fluid and reducing the partial stream (T2) allocated to the tangential inlet channels (4*a*, 4*b*, 4*c*, 4*d*) with a largest sum of the cross sectional areas at the point of connection (S1, S2) to the swirl chamber (3), versus the other partial stream (T1).

26. The method according to claim 11, wherein fluids are atomized with the help of gases, whereby the fluid or the gas or both are exposed either individually or in mixture to a variable swirling motion prior to exiting from the nozzle.

27. A nozzle system comprising a swirl generator in which fluids are put into rotation around an axis and comprising:

a swirl chamber (3) with a plurality of tangential inlet channels on a periphery of the swirl chamber (3), and a nozzle outlet opening;

a control element tied into at least one of said inlet channels outside of the swirl generator, said control element operating independently of through-put;

an outlet opening (6) on the swirl chamber;

wherein when there are two inlet channels (4*a*, 4*c*), said two inlet channels have different cross sectional areas at a point of connection (S1, S2) to the swirl chamber (3).

28. The nozzle system according to claim 27, wherein at the point of connection (S1, S2) to the swirl chamber (3), the tangential inlet channels having the same height and a different width (B1, B2).

29. The nozzle system according to claim 27, wherein the different cross sectional areas formed differ by more than four times.

30. The nozzle system according to claim 27, wherein thee control element (7, 11, 11') is tied into at least one feed line (8 or 9).

31. The nozzle system according to claim 30, wherein the control element is a pump (11, 11') or a valve (7).

32. The nozzle system according to claim 31, wherein the valve (7) is tied into the feed line (8 or 9) connected with the tangential inlet channels (4*a* or 4*b*) having a larger cross sectional area at the point of connection (S1, S2) with the swirl chamber (3).

33. The nozzle system according to claim 27, wherein a quotient between a diameter (D2) of the swirl chamber (3) and a diameter (D1) of the nozzle outlet opening (6) of the swirl chamber (3) is in a range of 2 to 12.

34. The nozzle system according to claim 27, wherein a ratio of a double width or a double diameter of an inlet opening of one of the inlet channels (4*a* or 4*b*) at said point of connection (S1, S2) to the swirl chamber (3) divided by a difference between a diameter (D2) of the swirl chamber and a diameter (D1) of the nozzle outlet opening is lower than 0.5.

35. The nozzle system according to claim 27, wherein feed lines (8, 9, 5*a*, 5*b*) have different connection cross sections, so that the feed lines connected with the tangential inlet channels having a largest cross sectional area at the point of connection (S1, S2) with the swirl chamber (3) have a larger connection cross section.

36. A nozzle system comprising a nozzle and a swirl generator in which fluids are put into rotation around an axis, comprising:

a swirl chamber (3) with a plurality of tangential inlet channels on a periphery of the swirl chamber (3);

a control element tied into at least one of the inlet channels outside of the swirl generator, said control element operating independently of throughput; and an outlet opening (6) on the swirl generator;

wherein when there are more than two tangential inlet channels (4*a*, 4*b*, 4*c*, 4*d*), said inlet channels have different or the same cross sectional areas at a point of connection (S1, S2) to the swirl chamber (3), and individual tangential inlet channels (4*a*, 4*b*, 4*c*, 4*d*) are connected with separate feed lines (8, 9), wherein a sum of cross sectional areas of the tangential inlet channels (4*a*, 4*b*, 4*c*, 4*d*) connected at said point of connection (S1, S2) to the swirl chamber (3) with different said feed lines (8 or 9) varies.

37. The nozzle system according to claim 36, wherein at the point of connection (S1, S2) to the swirl chamber (3), the tangential inlet channels having a same height as well as a same or a different width (B1, B2).

38. The nozzle system according to claim 36, wherein the sums of the cross sectional areas formed differ by more than four times.

39. The nozzle system according to claim 36, further comprising feed lines for connecting the tangential inlet channels to the swirl chamber, and wherein the tangential inlet channels (4*a*, 4*b*, 4*c*, 4*d*) with same cross sectional areas at the point of connection (S1, S2) to the swirl chamber (3) are connected with a common feed line (8 or 9).

40. The nozzle system according to claim 39, wherein the control element (7, 11, 11') is tied into at least one of the feed lines (8 or 9).

41. The nozzle system according to claim 40, wherein the control element is a pump (11, 11') or a valve (7).

42. The nozzle system according to claim 41, wherein the valve (7) is tied into the feed line (8 or 9) connected with the tangential inlet channels (4*a*, 4*b*, 4*c*, 4*d*) having a larger sum of cross sectional areas at the point of connection (S1, S2) with the swirl chamber (3).

43. The nozzle system according to claim 36, wherein center axes of the cross sectional areas of the tangential inlet channels (4*a*, 4*b*, 4*c*, 4*d*) at the point of connection with the swirl chamber (3) are disposed in one plane and the cross sectional areas are arranged with uniform distribution.

44. The nozzle system according to claim 36, wherein the tangential inlet channels (4*a*, 4*b*, 4*c*, 4*d*) are arranged disposed on a same axial coordinate.

45. The nozzle system according to claim 36, further comprising a pump (11) tied into a feed line (10) for a total stream of fluid (FG), said feed line being divided in two partial stream lines (8, 9) connected with separate channels (5*a*, 5*b*, 4*a*', 4*b*', 4*c*', 4*d*') located in the nozzle (14), said separate channels each being connected with one of the tangential inlet channels (4*a*, 4*b*, 4*c*, 4*d*) and having different cross sectional areas at the point of connection (S1, S2) with the swirl chamber (3); and further comprising a valve (7) tied into the stream line (8) connected with the tangential inlet channel (4*a*) having a larger cross sectional area at the point of connection (S1, S2) with the swirl chamber (3).

46. The nozzle system according to claim 36, further comprising a pump (11) tied into a feed line (10) for a total stream of fluid (FG), said feed line (10) being divided in two partial stream lines (8, 9) connected with separate inlet channels (5*a*, 5*b*, 4*a*', 4*b*', 4*c*', 4*d*') located in the nozzle (14), whereby one of the channels (5*a*) is connected with a tangential inlet channel (4*a*) and another channel (5*b*) with a plurality of tangential inlet channels (4*b*, 4*c*, 4*d*), and further comprising a valve tied into the partial stream line (8) connected with the plurality of tangential inlet channels.

47. The nozzle system according to claim 36, wherein the nozzle (14) is connected with two separate feed lines (8, 9) each having a pump (11, 11') tied into it, wherein one of said feed lines (9) is connected with one of said tangential inlet channels (4*a*) and the other feed line (8) with a plurality of said tangential inlet channels (4*b*, 4*c*, 4*d*).

48. The nozzle system according to claim 36, wherein a quotient between a diameter (D2) of the swirl chamber (3) and a diameter (D1) of the nozzle outlet opening (6) of the swirl chamber (3) is in a range of 2 to 12.

49. The nozzle system according to claim 36, wherein a ratio of a double width or a double diameter of an inlet opening of one of the inlet channels (4*a*, 4*b*, 4*c*, 4*d*) at said point of connection (S1, S2) to the swirl chamber (3) divided by a difference between a diameter (D2) of the swirl chamber and a diameter (D1) of the nozzle outlet opening is lower than 0.5.

50. The nozzle system according to claim 36, wherein feed lines (8, 9, 5*a*, 5*b*) have different connection cross sections, so that the feed lines connected with the tangential inlet channels having a largest cross sectional area or sum of cross sectional areas at the point of connection (S1, S2) with the swirl chamber (3) have a larger connection cross section.

* * * * *